United States Patent [19]

Stöckmann et al.

[11] Patent Number: 4,602,746

[45] Date of Patent: Jul. 29, 1986

[54] CONE CRUSHER LABYRINTH SEAL

[75] Inventors: Helmut Stöckmann, Wesseling; Klaus Schütte, Cologne, both of Fed. Rep. of Germany

[73] Assignee: Klöckner-Humboldt-Deutz AG, Fed. Rep. of Germany

[21] Appl. No.: 672,787

[22] Filed: Nov. 19, 1984

[30] Foreign Application Priority Data

Nov. 19, 1983 [DE] Fed. Rep. of Germany ..... 3341857

[51] Int. Cl.[4] ..... B02C 2/04

[52] U.S. Cl. ..... 241/215; 241/216

[58] Field of Search ..... 241/101.2, 207–216

[56] References Cited

U.S. PATENT DOCUMENTS 4,179,076 12/1979 Barrot et al. ..... 241/216

FOREIGN PATENT DOCUMENTS 1278199 6/1969 Fed. Rep. of Germany .

432848 8/1935 United Kingdom ..... 241/216

OTHER PUBLICATIONS

Kennedy: Crushers, Conveyors, Elevators, Screens, Classifiers, etc., Bulletin 49-A, 4-1949.

SKF Kugellager Rollenlager, 12-1957.

Dubbels Taschenbuch fur den Maschinenbau, 12-1966.

*Primary Examiner*—Mark Rosenbaum

*Attorney, Agent, or Firm*—Hill, Van Santen, Steadman & Simpson

[57] ABSTRACT

For cone crushers comprising an eccentrically-driven crushing cone, it is necessary to provide a labyrinth seal between the inwardly disposed eccentric drive and the crushing cone, the upper seal half thereof being connected to the crushing cone and the lower seal half thereof being connected to the eccentric drive. A new labyrinth seal is essentially distinguished in that helically extending fluids are provided on at least one wall of a cylindrical ring of the lower and/or upper seal half. It is thereby achieved that the slight air flow constantly emerge from the sealing gap and a penetration of dust into or, respectively, through the sealing gap is reliably prevented.

10 Claims, 4 Drawing Figures

CONE CRUSHER LABYRINTH SEAL

BACKGROUND OF THE INVENTION

1. Field of the Invention

The present invention relates to a cone crusher comprising an eccentrically-driven crushing cone wherein a labyrinth seal is disposed between the eccentric drive and the crushing cone, the upper, cylindrical sealing half thereof being connected to the crushing cone and the lower, cylindrical sealing half thereof being connected to the eccentric drive whereby the seal halves are designed of such length that a remaining coverage adequate for sealing remains in the highest position of the crushing cone and the upper seal half does not strike against the lower seal half in the lowest position of the crushing cone.

2. Description of the Prior Art

A cone crusher of the type generally set forth above is known, for example, from the German published application No. 12 78 199. The labyrinth seal of this cone crusher is formed by two seal halves, whereby the labyrinth gaps thereof are filled with grease in order to prevent the penetration of dust into the interior of the crusher. The grease feed generally occurs through an opening located in the outer labyrinth housing. The gap width between the overlapping seal halves, however, must be kept relatively small in order, on the one hand, to prevent the penetration of dust into the interior of the labyrinth seal or, respectively, of the cone crusher and on the other hand, in order to avoid too great a loss of grease during the emergence of grease from the labyrinth gap. It is thereby disadvantageous that the grease feed for a relatively large quantity of grease occurs only through one opening provided in the outside of the labyrinth housing, so that only an irregular distribution of the grease in the outer labyrinth gap and an insufficient sealing of the labyrinth gap against the penetration of dust into the interior of the crusher could be achieved. Moreover, this type of grease lubrication of the labyrinth gaps requires a relatively high time and cost expense, particularly since the penetration of grease into the labyrinth gap through an opening disposed in the labyrinth housing lasts a relatively long time and the crusher must be shut down for this purpose. Furthermore, multi-stage labyrinth seals are typical to manufacture and unnecessarily increase the structural volume of the cone crusher in this region.

SUMMARY OF THE INVENTION

It is therefore the object of the present invention, given a cone crusher, to provide an improved labyrinth seal between the eccentric drive and the crushing cone such that dust or water are reliably prevented from penetrating into the interior of the cone crusher and, therefore, into the oil circulation, the prevention being without or with only a minimum of grease feed with a uniform grease distribution in the sealing gap.

The above object is achieved, according to the present invention, in that flutes are disposed on at least one wall of a cylindrical ring given the lower end/or upper seal half. As a result of fashioning flutes on the wall of a cylindrical ring, the smooth wall of such a ring is advantageously interrupted. The laminar air boundary layer is distributed and numerous small air turbulences are formed at the circumnavigant fluting edges, these yielding an overall air movement out of the sealing gap, and, therefore, producing a blocking effect. The coefficient of friction of the revolving wall of the cylindrical ring with the air located in the sealing gap or, respectively, surrounding the cylindrical ring is thereby very significantly increased and the dust, or even water, are reliably prevented from penetrating into the interior of the cone crusher.

It is provided, according to a particular feature of the invention, that the flutes on the wall of the cylindrical ring are designed serrated. Sharp, circumnavigent flute edges are thereby very advantageously produced on the wall of the cylindrical ring, these enabling a good meshing into the phase boundary layer of the air surrounding the cylindrical ring. An air transport out of the seal is especially achieved when the sharp-edged serrated shoulders of the flutes are designed opposing the penetration direction of dust particles out of the crusher chamber into the labyrinth seal.

It is further provided, according to another feature of the invention, that the flutes disposed on the wall of the cylindrical ring are fashioned preceding in the manner of a helix. Given rotation of the cylindrical ring or, respectively, cylindrical ring, the helically-extending flutes exert a force in the axial direction on the air located at the surface of the wall of the cylindrical ring. Given a corresponding rotational sense, a transport of the air layer located at the surface of the wall of a cylindrical ring in the axial direction is very advantageously achieved. The conveying direction of the air coincides with the direction of the serrated flute shoulders and is opposite the penetration direction of dust particles into the seal. In a simple and advantageous manner, therefore, a constant, slight air stream directed through the labyrinth seal from the interior to the exterior is built up, this air stream reliably preventing the penetration of dust particles and moisture through the seal into the interior of the cone crusher.

It is provided, according to a further feature of the invention, that the lower seal half is designed strengthened at the side lying opposite the unbalanced mass of the eccentric bush. An additional balancing of the unbalanced mass of the rotating eccentric bush and of the eccentrically-orbiting cone masses is thereby advantageously achieved, whereby the center of gravity of the lower seal half, designed strengthened at one side, is placed close to the plane in which the center of gravity of the eccentric bush and of the cone are located.

The bearing surfaces are subject to lower loads given a far-reaching compensation of the unbalanced masses and the cone crusher achieves smoother running overall.

According to a particular feature of the invention, it is provided that the upper seal half is composed of a one-piece cylindrical ring and the lower seal half is composed of two cylindrical rings disposed at a distance from one another, whereby an interrupted annular opening leading to the exterior is disposed in the outer ring of the lower seal half. The slight air stream coming from the interior and emerging from the seal can flow off unimpeded toward the exterior into the housing of the cone crusher through the outwardly-extending, interrupted annular opening in a simple and advantageous manner.

According to a further feature of the invention, it is provided that the outer ring of the lower seal half is designed with a wedge-shaped cross section extending from top to bottom and forms an annular gap with the inner ring, the annular gap expanding conically towards the bottom. Very advantageously created in this manner is the possibility that the rotational motion of the cylindrical rings exerts a centrifugal force on the dust particles entering into the outer sealing gap and these dust particles are hurled in the radial direction against the inner wall of the outer ring, the inner wall tapering wedge-like from top to bottom, then execute a movement in the axial direction and can re-enter into the crusher housing through the interrupted annular opening leading the exterior of the seal. In that the upper gap width of the outermost sealing gap is kept very small and the annular opening disposed at the bottom in the outermost ring is designed broader, a minimal underpressure arises in the annular gap located between the outer and inner rings of the lower seal half which is conically expanded towards the bottom. This underpressure exercises a partial extraction effect on the dust-containing air that enters at the top, so that the dust-containing air flows past the inner sealing gap or, respectively, is kept away from that gap and is conducted towards the exterior back into the crusher housing through the annular opening in the outer ring.

A sufficient seal is guaranteed due to the blocking effect of the profile seal and coverage of the gap in comparison to smoothly-executed surfaces, even given deflection or axial dislocation of the crushing cone or, respectively, given its return into a normal position after foreign bodies have passed through the crushing gap.

Dust or fluid particles are thereby reliably prevented from having access to the inner sealing gap and from penetrating into the interior of the cone crusher, or, respectively, of the eccentric drive According to another feature of the invention, blade-like elements directed into the conically-expanding annular gap are disposed at the interior wall of the outer ring of the lower seal half. These blade-like elements extend from top to bottom, preferably obliquely relative to the axial direction and are also obliquely designed in the radial direction. In terms of operation, these blade-like elements correspond to the impeller vanes of an axial acting blower. They promote the axial motion of dust-laden air in the outer sealing gap in a vane-like manner, this motion having been produced by the minimal underpressure and, during operation of the cone crusher, convey the dust-laden air entering into the outer sealing gap from the top down toward the outwardly-leading, interrupted annular opening through the dust-laden air flows back into the pressure housing.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
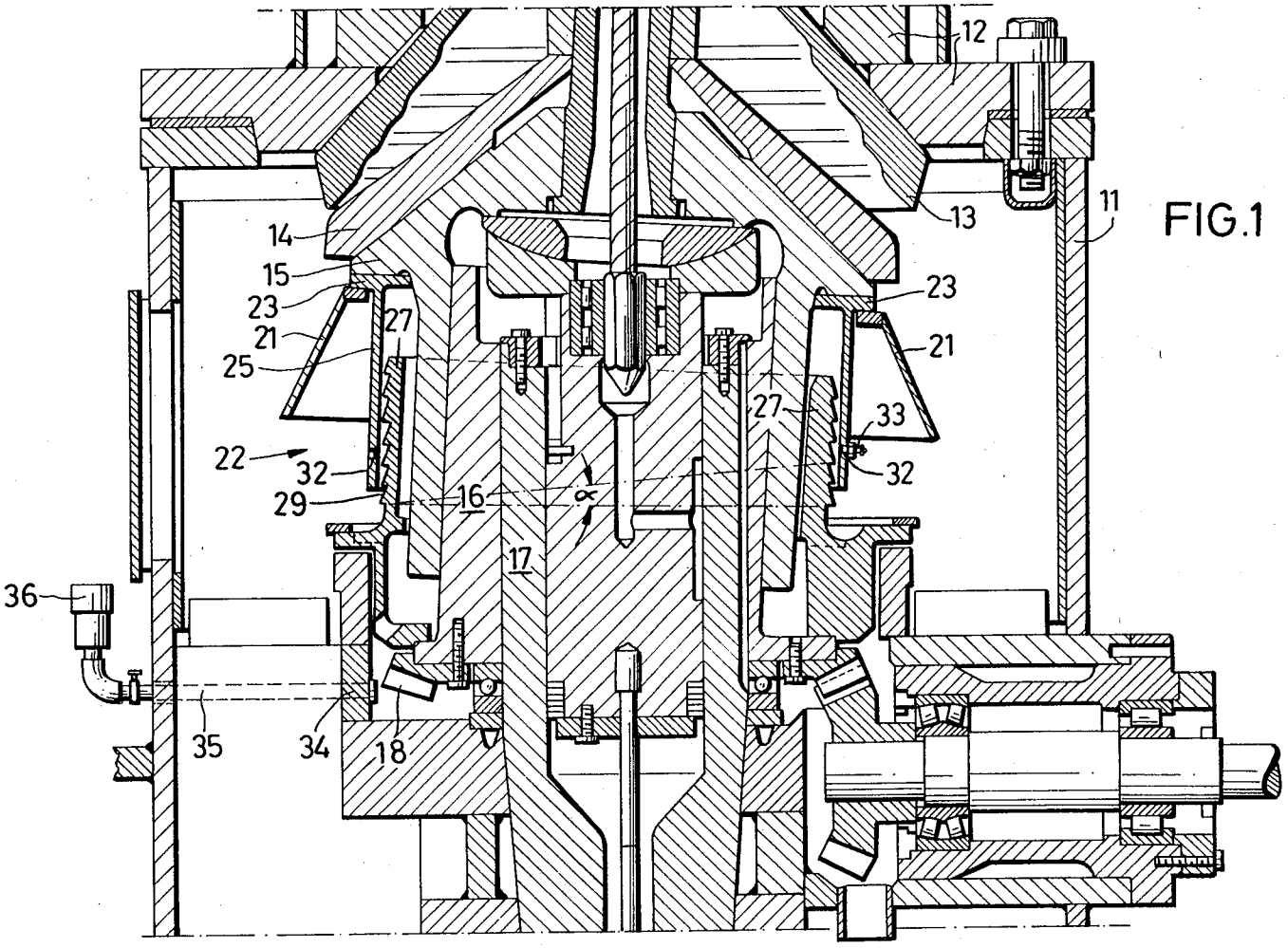
FIG. 1 is a sectional view of a cone crusher comprising a labyrinth seal constructed in accordance with the present invention.

Referring to FIG. 1, the exterior of the cone crusher is composed of a lower housing portion 11 and an upper housing portion 12 secured thereto. Disposed within the housing portion 11, 12 as wear-resistant crushing tools are an upper, conical crushing mantle 13 and a crushing cone 14 seated therebelow, the latter being secured to the carrying cone 15. The carrying cone 15 with the crushing cone 14 is guided in a sliding fashion on an eccentric bush 16 which, in turn, is guided in a sliding fashion in a cylindrical hollow shaft 17.

The eccentric bush 16 is driven by a drive motor (not shown in detail on the drawing) via a conical gear rim 18 located at its lower edge and by way of a conical pinion 19 on a drive shaft 20.

A labyrinth seal 22 is disposed between the eccentric drive and the crushing cone 14, the upper, cylindrical seal half thereof being connected by way of a flange 23 to the carrying cone 15 and the lower seal half thereof being connected to the eccentric drive, whereby the two seal halves are designed of such length that a remaining overlap sufficient for a seal remains in the highest position of the crushing cone 14 and the upper sealing half does not strike against the lower seal half in the lowest position of the crushing cone 14. The top of the labyrinth seal 22 is protected against direct impact of a product to be crushed and against dust by a conical protective plate 21 secured to the carrying cone 15 via the flange 23. A sealing gap S1, whose gap width is extremely small, is located between the cylindrical ring 25 of the upper seal half and the ring 27 of the lower seal half. Circumnavigent, preferably serrate flutes 29 whose sharp-edged flute shoulders are downwardly directed to the end of the sealing gap S1 are located on the outer wall of the cylindrical ring 27. In order to achieve a slight conveying effect of air through the sealing gap S1 from top to bottom, the grooves extend helically on the wall of the ring 27, whereby multiple, preferably four, parallel flutes orbit helically in order to achieve an adequate helix angle $\alpha$. The flutes 29 are designed open at their beginning and end. Due to the rotational motion of the lower seal half with the helical flutes 29, a certain transport of air from the interior of the eccentric drive through the sealing gap S1 towards the exterior of the crushing space occurs. A penetration of dust-laden air in the opposite direction into the interior of the eccentric drive is thereby reliably prevented. A circumnavigent annular groove 32 is disposed in the inner wall of the cylindrical ring 25 of the upper seal half in the lower range thereof. The groove 32 can be filled with grease from the outside by way of a grease fitting 33. In operation, the grease is pressed into the annular groove 32 or, respectively, against the interior wall as a result of centrifugal force and reduces the sealing gap S1 to the smallest possible dimension. Excess grease is transported downwardly out of the sealing gap S1 by the serrate flute shoulders. Should, despite the air flowing out of the sealing gap, isolated, superfine dust particles penetrate into the sealing gap from below, then the same are hurled toward the exterior by the centrifugal force and adhere to the grease in the annular groove 32. However, the dust particles are repeatedly stripped from the surface of the grease in the annular groove by the rotating flute shoulders and are downwardly discharged out of the sealing gap S1. A bore 34 is provided at a suitable location in the lower housing of the eccentric drive in order to prevent an underpressure arising in the interior of the eccentric drive, an interior aeration of the eccentric drive occurring through the bore 34 by way of a feed 35 via an air-drying filter 36. Dry compressed air can also be supplied via the feed 35 as needed, this then emerging from the sealing gap as blocking air.

In the following discussion, the same reference characters have been retained for the same parts in FIGS. 2, 3 and 4.

Figure 2:
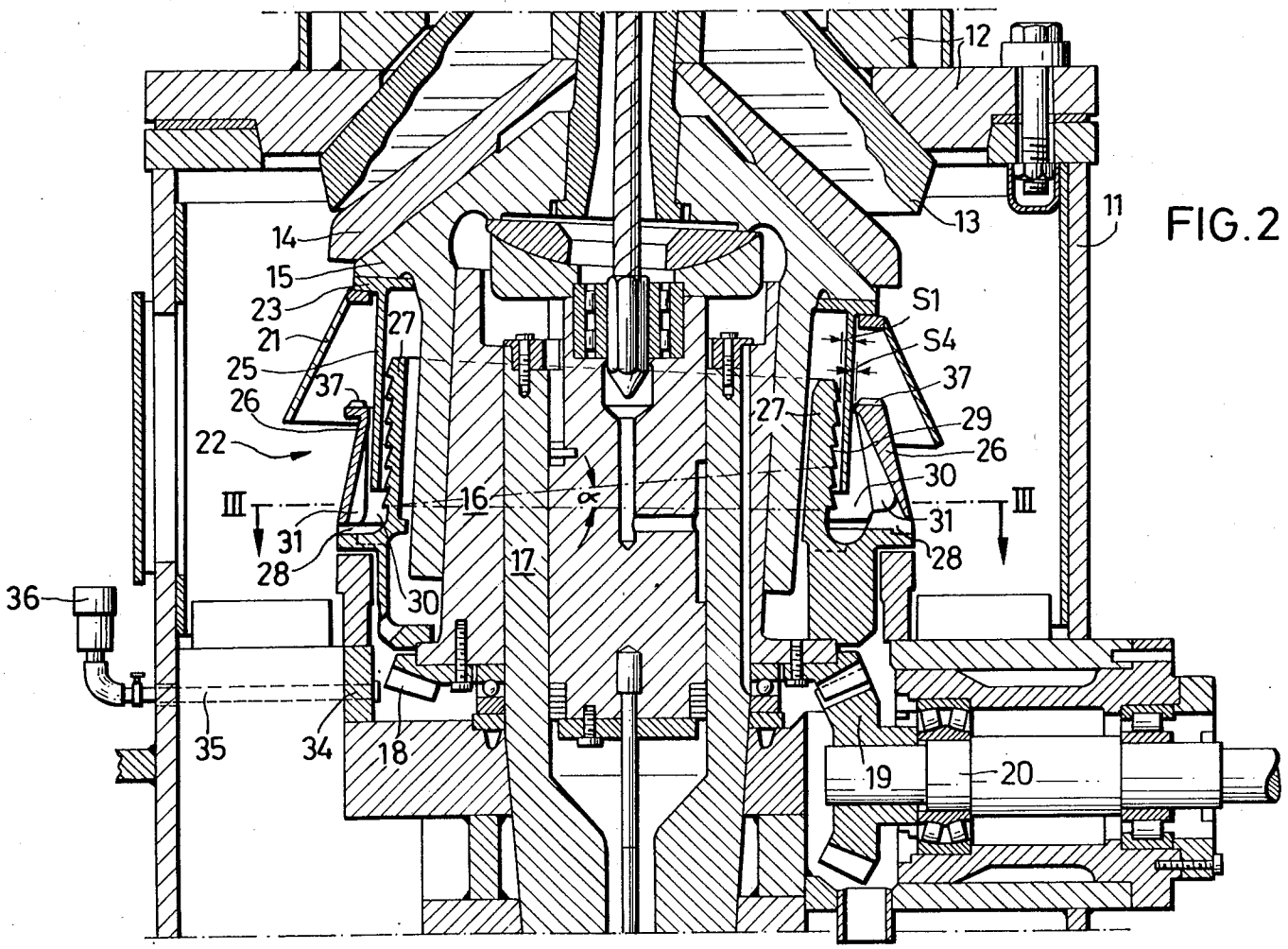
FIG. 2 is a sectional view of a cone crusher illustrating another embodiment of a labyrinth seal constructed in accordance with the present invention.

Given a further illustrative embodiment of the labyrinth seal of the invention, with reference to FIG. 2, the lower seal half is composed of two rings 26, 27 located at a distance from one another, whereby an outwardly-extending, interrupted annular opening 28 is located in the outer ring 26 of the lower seal half. As viewed in cross section, the lower seal half is designed strengthened at the side lying opposite the unbalanced mass of the rotating eccentric bush 16. The inner ring 27 and the outer ring 26 of the lower seal half forms an annular gap 30 into which the cylindrical ring 25 of the upper seal half engages extending downwardly from the top. The sealing gaps S1 and S4 are thereby formed at the inner and outer walls of the cylindrical ring 25. Again, as viewed in cross section, the wall of the outer cylindrical ring 26 of the lower seal half is designed with a wedge-shaped cross section extending from top to bottom, whereby the point of the wedge is directed to the interrupted annular opening 28. A plurality of narrow ribs 37 are disposed at the top of the outer cylindrical ring 26, the ribs being disposed directed in the radial direction. Disposed at the inner wall of the outer cylindrical ring 26 are a plurality of blade-like elements 31 uniformly distributed over the circumference which extend at a slant in both the radial direction and the axial direction and which can also be twisted in the longitudinal direction. Dust-laden air from the crusher housing which attempts to penetrate into the labyrinth seal must first flow from bottom to top under the protective plate jacket 21 and then undertake a directional change into the radial direction. Coarser dust particles thereby strike the edge of the outer ring 26 and are hurled towards the exterior by the radially-extending ribs 37 and are kept away from the sealing gap S4. After another change in direction, air containing superfine dust particles can penetrate into the sealing gap S4 from the top. Here, at the very latest, however, the dust particles are subjected to the centrifugal force deriving from the rotational movement of the labyrinth seal and are hurled towards the exterior against the wedge-shaped inner wall of the outer ring 26 of the lower seal half. Due to the annular gap 30, conically-expanded downwardly or, respectively, at the inner wall of the outer ring 26, the dust particles are conveyed downwardly to the interrupted annular opening 28 and are transported out back into the crusher housing and discharged together with the stream of crushed product. This conveying effect arises in the expanded annular gap 30 because the conical expansion generates a minimum underpressure which results in a suction effect. Air laden with superfine dust particles is reliably kept away from the middle sealing gap S1 as a result of this suction effect. The discharge of the dust particles is promoted by the blade-like element 31 which project into the annular gap 30 at an axial slant from top to bottom and at a radial slant.

The lower seal half can consist of a single piece. For cost-effective construction, however, it can also be fabricated of a plurality of ring parts designed strengthened at one side.

Figure 3:
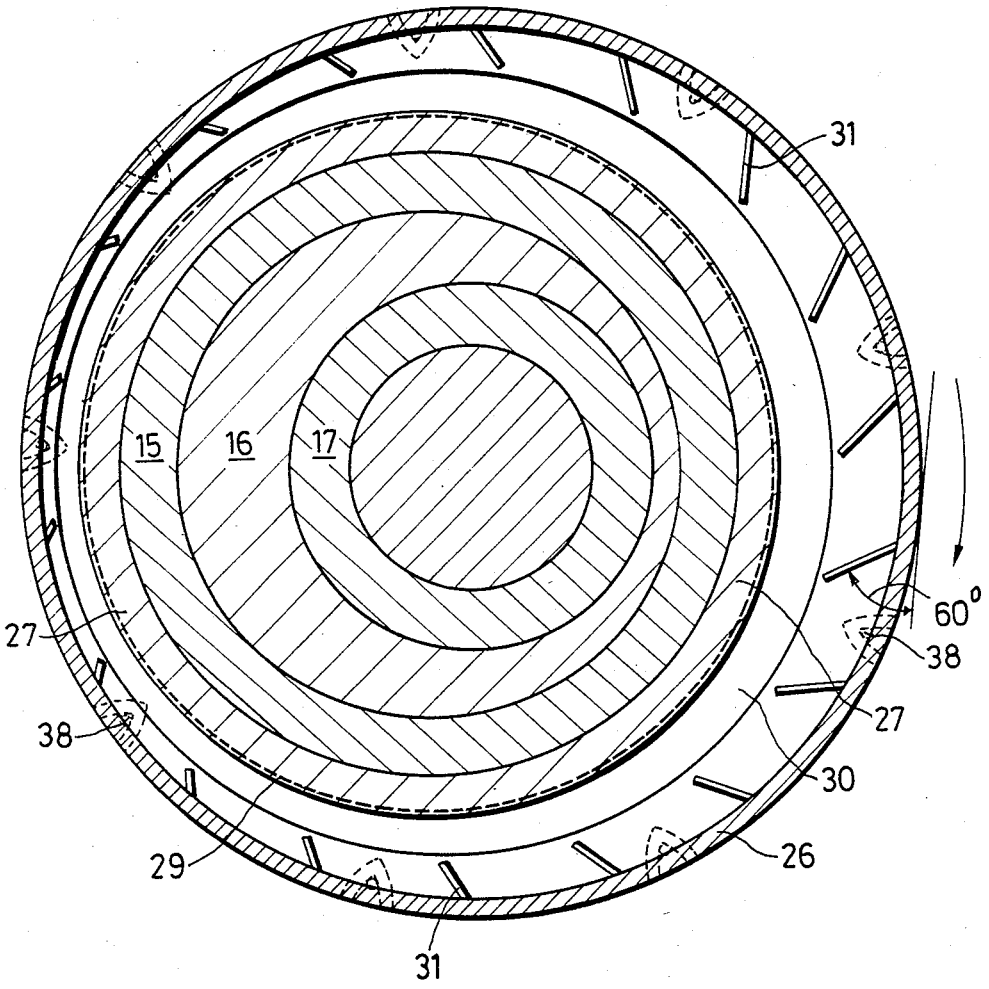
FIG. 3 is a cross-sectional view taken generally along the line III—III of FIG. 2.

FIG. 3 shows a cross section of the labyrinth seal 22 of the present invention of FIG. 2 and illustrates the strengthened design of the lower seal half at one side. The outer ends of the blade-like elements 31 are secured to the inner wall of the outer ring 26 of the lower seal half and their inner ends are directed at a radial slant in the rotational direction of the labyrinth seal. The oblique positioning in the radial direction occurs such that the upper ends of the blade-like element 31 are advanced in the rotational sense of the labyrinth seal, whereby they can also be twisted in and of themselves. Given cone crushers having, for example, 400 rpm which have speeds of about 15 m/sec in this circumferential region, preferably 24 blade-like elements 31 are to be applied to the inner wall of the outer ring 26 having an oblique attitude of about 60° directed in the rotational sense.

Spacer blocks 38 which are directed inwardly and in a wedge-shape structure are secured at both sides in the interrupted annular opening 38 for connecting the outer ring 26 to the lower seal half.

Figure 4:
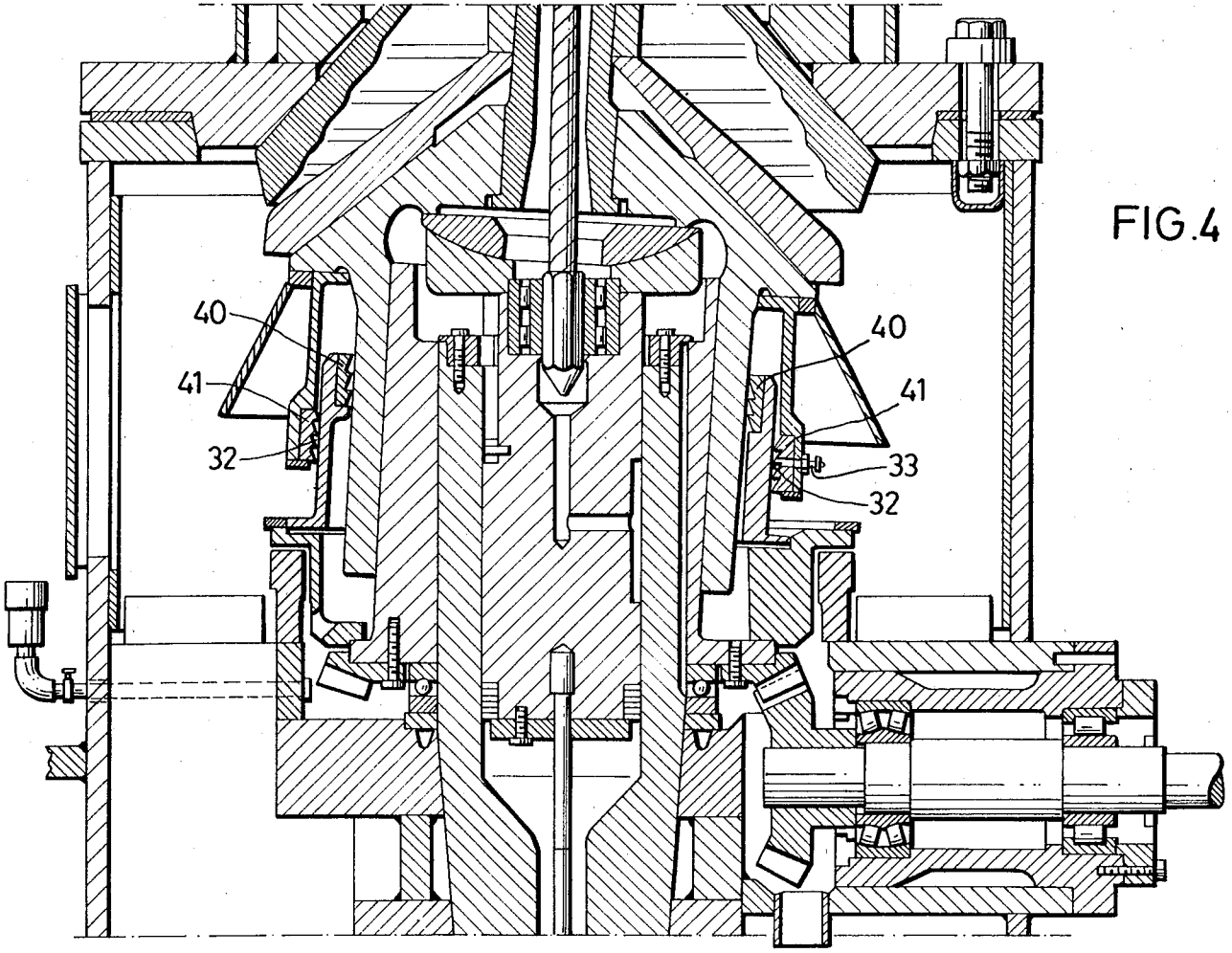
FIG. 4 is a sectional view of a cone crusher employing another embodiment of a labyrinth seal constructed in accordance with the invention.

In FIG. 4, the upper and lower seal halves respectively comprise a cylindrical ring 25, 27. Annular inserts 40, 41 of abradable material are provided at the seal ends of the cylindrical rings at the respective inner walls of the ring. The serrate flutes 29 extend on the inner walls of the annular insert 40, 41 of wear or, respectively, abradable material such as, for example, bronze, zinc, synthetic material, Teflon® or graphite, the pointed flute shoulders of the flutes 29 grinding in during the start-up mode and subsequently producing sealing gaps having the smallest possible gap width. A circumnavigent annular groove 32 having an externally accessible grease fitting 33 is again disposed in the inner wall of the outer, annular insert 41 of wear material which is located in the cylindrical ring 25 of the upper seal half. The points of the serrate flute shoulders of the helically circumnavigent flutes 29 are directed in respectively one direction and have such a pitch that air from the interior of the eccentric drive is conveyed out through the sealing gaps and renders a penetration of dust-laden air from the exterior into the interior of the eccentric drive impossible.

The seal arrangement can also be designed such that the upper seal half is composed of two cylindrical rings and the lower seal half is disposed of one cylindrical ring.

The annular inserts of wear material having helically-extending flutes can be subsequently applied to existing or, respectively, known smooth-wall labyrinth seals at any time in order to therefore achieve an improved sealing effect.

Depending on the requirements made of the seal, the proposed illustrative embodiments can be modified or, respectively, combined with one another so that an effective contact-free, wear-free and practically maintenance-free dust seal of the eccentric drive is created for cone crushers.

The application of the labyrinth seal of the present invention is also conceivable at other locating machine parts and housings whose sensitive internal apparatus must be sealed, for example, against the penetration of dust or air. The seal of the present invention could also be employed in rotary drums such as, for example, grinding systems of drum type driers.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a cone crusher of the type wherein an eccentric drive having an unbalanced mass on an eccentric bush is connected to and drives an orbital crushing cone, in which a seal just below the crushing cone in the region of the downfalling crushed material includes an upper cylindrical ring connected to the crushing cone and a lower cylindrical ring connected to the eccentric drive and overlapped by the upper cylindrical ring, in which the cylindrical rings create a sealed region and are dimensioned such that they remain overlapped at all axial movements of the crushing cone from the uppermost position of the crushing cone and do not strike one another in the lowermost position of the crushing cone, the improvement wherein:

the lower cylindrical ring comprises serrate means defining a plurality of grooves on its vertical wall for creating a flow of air out of the sealed region; and the lower cylindrical ring further comprises a strengthened portion opposite to the unbalanced mass.

2. The improved cone crusher of claim 1, wherein:

the upper cylindrical ring and the lower cylindrical ring both comprise serrate means defining a plurality of grooves therein.

3. The improved cone crusher of claim 1, wherein:

said serrate means comprises a helically-extending ridge.

4. The improved cone crusher of claim 1, wherein:

an external air feed is connected in fluid communication with the sealed region.

5. In a cone crusher of the type wherein an eccentric drive having an unbalanced mass on an eccentric bush is connected to and drives an orbital crushing cone, in which a seal just below the crushing cone in the region of the downfalling crushed material includes an upper cylindrical ring connected to the crushing cone and a lower cylindrical ring connected to the eccentric drive and overlapped by the upper cylindrical ring, in which the cylindrical rings create a seal region and are dimensioned such that they remain overlapped at all axial movements of the crushing cone of the uppermost position of the crushing cone and do not strike one another in the lowermost position of the crushing cone, the improvement wherein:

a lower outer cylindrical ring is provided and is connected to the eccentric drive;

the lower inner cylindrical ring comprises serrate means defining a plurality of grooves on the outside of its vertical wall for creating a flow of air out of the seal region, and a strengthened portion opposite the unbalanced mass; and the lower outer ring further comprises an interrupted annular opening for supporting the flow of air, and a wedge-shaped cross-section member; and the lower inner ring is spaced from said wedge-shaped cross-section member to form a gap receiving the upper cylindrical ring therein.

6. The improved cone crusher of claim 5, and further comprising:

a plurality of blades on the inner surface of said wedge-shaped cross-section member.

7. The improved cone crusher of claim 6, wherein:

each of said blades is oblique with respect to the axial direction of the crusher.

8. The improved cone crusher of claim 6, wherein:

each of said blades is oblique with respect to the radial direction of the crusher.

9. The improved cone crusher of claim 5, wherein:

said serrate means defining said grooves comprises abradable material.

10. The improved cone crusher of claim 5, wherein:

an external air feed is connected in fluid communication with the sealed region.

* * * * *